US008641788B2

(12) United States Patent
Lamoureaux et al.

(10) Patent No.: US 8,641,788 B2
(45) Date of Patent: Feb. 4, 2014

(54) FUELS AND FUEL ADDITIVES COMPRISING BUTANOL AND PENTANOL

(75) Inventors: James S. Lamoureaux, Minneapolis, MN (US); Theo H. Fleisch, Breckenridge, CO (US)

(73) Assignee: IGP Energy, Inc., George Town (KY)

( * ) Notice: Subject to any disclaimer, the term of this patent is extended or adjusted under 35 U.S.C. 154(b) by 0 days.

(21) Appl. No.: 13/314,156

(22) Filed: Dec. 7, 2011

(65) Prior Publication Data

US 2012/0090226 A1 Apr. 19, 2012

(51) Int. Cl.
*C10L 1/18* (2006.01)

(52) U.S. Cl.
USPC ..... 44/452

(58) Field of Classification Search
USPC ..... 44/452
See application file for complete search history.

(56) References Cited

U.S. PATENT DOCUMENTS 4,540,713 A * 9/1985 Hardman et al. ..... 518/713
4,695,292 A * 9/1987 Osborg ..... 44/416
4,756,803 A 7/1988 Berg
4,956,392 A 9/1990 Saito et al.
5,417,813 A 5/1995 Berg
5,554,794 A 9/1996 Johnson
5,752,992 A 5/1998 Hendriksen
5,961,789 A 10/1999 Berg
5,968,211 A 10/1999 Schilowitz
6,270,540 B1 8/2001 Lin et al.
6,821,659 B2 11/2004 Surampudi et al.
6,827,750 B2 12/2004 Drozd et al.
6,835,218 B1 12/2004 Drozd et al.
6,840,970 B2 1/2005 Schwahn et al.
6,858,047 B1 2/2005 Norman
6,860,911 B2 3/2005 Hundley
6,884,271 B2 4/2005 Wenzel
6,923,838 B2 8/2005 Maubert et al.
6,969,773 B2 11/2005 Stewart
6,986,327 B2 1/2006 May
7,063,729 B2 6/2006 Valentine et al.
7,141,083 B2 11/2006 Jordan
7,144,433 B2 12/2006 Jordan
7,144,434 B2 12/2006 Jordan
7,144,435 B2 12/2006 Jordan
7,160,338 B2 1/2007 Jordan
7,160,339 B2 1/2007 Jordan
7,172,635 B2 2/2007 Bongardt et al.
7,182,797 B2 2/2007 Mekonen
7,195,654 B2 3/2007 Jackson et al.
7,217,851 B1 5/2007 Suri et al.
7,250,065 B1 7/2007 Gunther et al.
7,282,072 B2 10/2007 Taulbee
7,285,140 B2 10/2007 Valentine
7,300,477 B2 11/2007 Brennan et al.
7,332,001 B2 2/2008 Guinther et al.
7,357,819 B2 4/2008 Killick et al.
7,374,589 B2 5/2008 Bernasconi et al.
7,402,186 B2 7/2008 Spivey et al.
7,438,731 B2 10/2008 Watanabe et al.
7,458,368 B1 12/2008 Huffman
7,491,247 B1 2/2009 Jakush et al.
7,491,249 B2 2/2009 Foote et al.
7,503,944 B2 3/2009 Carroll et al.
7,542,338 B2 6/2009 Scheuerlein et al.
7,597,725 B2 10/2009 Caprotti et al.
7,598,426 B2 10/2009 Fang et al.
7,601,185 B2 10/2009 Schwahn et al.
7,604,762 B2 10/2009 Blanchard et al.
7,635,699 B2 12/2009 Meng et al.
7,659,105 B2 2/2010 Burd et al.
7,699,900 B2 4/2010 Ruiz
7,732,173 B2 6/2010 Mairal et al.
7,737,311 B2 6/2010 Cracknell et al.
7,740,710 B2 6/2010 Notari et al.
7,744,661 B2 6/2010 Braakman et al.
7,745,382 B2 6/2010 Sloan
7,754,928 B2 7/2010 Manzer
7,772,414 B1 8/2010 Hybertson et al.
7,785,378 B2 8/2010 O'Rear
7,799,544 B2 9/2010 Schorken et al.
7,803,200 B2 9/2010 Oh
2009/0205246 A1 8/2009 Tsuchida et al.
2010/0005709 A1 * 1/2010 Bradin ..... 44/452

OTHER PUBLICATIONS

Powerpoint presentation from the Center for Alternative Fuels, Engines, and Emissions of the West Virginia University, Jun. 7, 2010.
J.L. Smith et al., "Alcohol for Motor Fuels", Colorado State University, reviewed Dec. 2004.
Compendium of Experimental Cetane Number Data of Subcontractor Report, National Renewable Energy Laboratory, 2004, NREL/SR-540-36805.
B. Freedman et al., "Predicting Cetane Numbers of n-Alcohols and Methyl Esters from their Physical Properties", JAOCS, 1990, vol. 67, No. 9 , P565-P571.
John Williams, et al. "Impact of Butanol and Other Bio-Components on the Thermal Efficiency of Prototype and Conventional Engines", SAE International, 2009-01-1908, 2009.
Jing Yang et al., "Dyno Test Investigations of Gasoline Engine Fueled with Butanol-Gasoline Blends", SAE International, 2009-01-1891, 2009.
Sriram S. S. Popuri et al., "A Performance Study of Iso-Butanol-,Methanol-, and Ethanol-Gasoline Blends Using a Single Cylinder Engine", SAE International, 932953, 1993.
Yi Yang et al., "Characteristics of Isopentanol as a Fuel for HCCI Engines", SAE International, 2010-01-2164, 2010.
Kapila Wadumesthrige et al., "Properties of Butanol-Biodiesel-ULSD Ternary Mixtures", SAE International, 2010-01-2133, 2010.
Leslie Bromberg et al., "Alcohol Fueled Heavy Duty Vehicles Using Clean High Efficiency Engines", SAE International, 2010-01-2199, 2010.
Gautam et al., "Combustion characteristics of higher-alcohol/gasoline blends," Proceedings of the Institution of Mechanical Engineers, Part A: Journal of Power and Energy, 214:497-511 (2000).

* cited by examiner

*Primary Examiner* — Cephia D Toomer
(74) *Attorney, Agent, or Firm* — Jones Day

(57) ABSTRACT

Disclosed herein are fuels and/or fuel additives comprising butanol and pentanol. In particular, the fuels and/or fuel additives comprise from about 45 vol. % to about 90 vol. % of butanol and from about 10% to about 55% of pentanol, based on the total volume of the fuels or the fuel additive. Also disclosed herein are fuel compositions comprising fuels or fuel additives, which comprise from about 45 vol. % to about 90 vol. % of butanol and from about 10% to about 55% of pentanol. The fuels and/or fuel additives may also comprise minor amounts of methanol, ethanol, propanol, hexanol, heptanol, and/or octanol.

17 Claims, No Drawings

FUELS AND FUEL ADDITIVES COMPRISING BUTANOL AND PENTANOL

FIELD OF THE INVENTION

This invention encompasses, among other things, fuels and/or fuel additives comprising butanol and pentanol. In particular, this invention encompasses fuels and/or fuel additives comprising from about 45 vol. % to about 90 vol. % of butanol and from about 10% to about 55% of pentanol, based on the total volume of the fuels or the fuel additive. This invention also encompasses fuel compositions comprising fuel additives disclosed herein.

BACKGROUND OF THE INVENTION

It is well known that air pollution is a serious issue worldwide and carbon dioxide released by industrial production and internal combustion engines can lead to significant global climate changes. A significant amount of the pollution and carbon dioxide emissions comes from automobiles and other mechanized vehicles such as airplanes, ships, and diesel trucks, which continue to proliferate. Furnaces, boilers and gasifiers using combustion to generate power is another source of pollution and carbon dioxide emissions.

Most of these internal combustion engines, furnaces, boilers and gasifiers run on petroleum-based fuels, such as gasoline, jet fuel, diesel fuel, fuel oil, heating oil and bunker oil. When such fuels are burned, not all of the energy is used and some of the energy is transferred as heat and is lost through the engine (or furnace) surface and the hot exhaust. This exhaust comprises a variety of gases and particulates such as carbon dioxide ($CO_2$), carbon monoxide (CO), nitrous oxides ($NO_x$), sulfur dioxides ($SO_x$), unburned hydrocarbons and soot particulates. All of these are pollutants and each has negative environmental consequences.

In addition, the low boiling point components of gasoline can evaporate when exposed to heat. This evaporation is one of the sources of Haxardous Air Pollutants (HAPs) and volatile organic compounds (VOCs). VOCs and HAPs are toxic to humans and can produce ozone, which is a component of smog as well as a layer in the atmosphere that traps heat.

One potential solution that addresses both the issue of oil scarcity and environmental effects of burning petroleum-based fuels or coal-based fuels is alcohol-based fuels. Several alcohol-based fuels have been proposed in the past, such as methanol and ethanol. Furthermore, hazardous additives such as lead and methyl tert-butyl ether (MTBE) in gasoline can also cause health hazard. The present solution has been to replace these hazardous additives with methanol and ethanol. However, as explained below, there are a number of disadvantages of using ethanol, methanol or other lower alcohols as fuel additives or fuels.

Typically, ethanol is fermented from food crops, primarily grains such as corn, wheat, barley, oats and a variety of other farm grown commodities, often called "biomass." While ethanol is promoted as a clean, green fuel since the base feedstock is renewable, it has not been a panacea for solving the environmental issues and the oil scarcity issues because a significant amount of energy and fertilizer are needed to produce the feedstock and the ethanol.

Alcohols produced from food as a feedstock are expensive and subject to weather conditions and fluctuations in harvests as well as government regulations. For example, the Chinese government does not allow the use of a food product as a feedstock for producing fuels.

Ethanol can be blended into gasoline at a rate of roughly 7% to 10%. Recent fuel testing at higher levels have shown that engines that are not specifically set up to use ethanol have more wear on the parts leading to a reduction in engine life. Other blends such as E-85, which is 85% ethanol and 15% gasoline, can only be used in engines specifically designed and built to use that fuel blend. Only a very small proportion of the total number of automobiles built are able to use E-85.

Methanol blends such as M-85 (85% methanol and 15% gasoline) are even more problematic. Methanol does not dissolve in gasoline in all proportions. The solubility of methanol in gasoline is a function of both the composition of the mixture and temperature but, in general, mixtures having a methanol content between 15% and 85% tend to separate into two phases. While flexible fuel vehicles can tolerate phase separation in the vehicle fuel tank, it does create a problem in the distribution system as there is no easy way to control the quality of the fuel being dispensed.

Water is vey soluble in methanol and ethanol. Therefore, ethanol or methanol blended fuels, at higher alcohol percentages by volume, have greater propensity to absorb a large amount of water or even exhibit phase separation, which may cause problems in the distribution system of vehicles and pipelines. Consequently, this limits the level of ethanol or methanol that can be safely blended and transported through pipelines.

Methanol can corrode the metal components and wears down the elastomeric components of conventional vehicle fuel systems. One solution to this problem is a redesigned engine using stainless steel and methanol resistant elastomers, but this adds cost to vehicle production. Furthermore, methanol vehicles require special engine oil and larger fuel tanks for having to carry more fuel due to its lower specific heating value and lower energy density than those of gasoline.

Another problem for both ethanol and methanol is that they have a high oxygen content and therefore have lower energy densities than other fuel components. The energy density of methanol and ethanol are respectively 57,000 and 76,000 British Thermal Units (Btus) per gallon, both of which are much lower than gasoline ~114,500 Btus per gallon. Due to this lower energy content, more ethanol and methanol fuel is needed to achieve the same energy level, translating into a loss of mileage in the case of automobiles or trucks, or a higher consumption of fuel in the case of furnaces.

As for diesel blending, methanol, due to its highly polar nature, is not soluble in diesel fuel and ethanol is only soluble in diesel fuel if it contains very little water. Even if ethanol and methanol could be blended into diesel fuel, their low cetane levels would reduce the cetane level of the diesel fuel to a point where the cetane rating will likely decrease below the level recommended by the engine manufacturer, preventing operation. Further, ethanol does not provide lubrication for the fuel injection system, which is another problem with blending ethanol into diesel fuel. Another problem of these alcohols is the vapor pressure. Methanol and ethanol are too volatile to meet the requirements necessary for diesel fuel to operate as they tend to vaporize in the fuel mixture.

As a result, there are needs for environmental friendly fuel additives to replace the current fuel additives such as MTBE, ethanol and methanol. There are also needs for environmental friendly higher alcohol-based fuels to replace the petroleum-based fuels or the lower alcohol-based fuels. There are also needs for alcohol-based fuels that are not produced from food as a feedstock. There are also needs for alcohol-based fuels that can reduce wear of the engine, the fuel injection system and elastomeric components. There are also needs for alcohol-based fuels that can be blended with gasoline or other petroleum-based fuels with little or no phase separation. There are also needs for higher alcohol-based fuels that have higher energy densities than those of lower alcohol-based fuels.

SUMMARY OF THE INVENTION

Provided herein are fuels, fuel additives and/or fuel compositions comprising butanol and pentanol and optionally one or more other alcohols such as methanol, ethanol, propanol, hexanol, heptanol, octanol or a combination thereof. The fuels, fuel additives and/or fuel compositions provided herein are believed to satisfy the above-mentioned needs. The fuels, fuel additives and/or fuel compositions disclosed herein can be used for internal combustion engines such as gasoline engines, diesel engines, jet engines and ship engines; or furnaces, boilers and gasifiers.

In one aspect, provided herein is a fuel comprising:

(a) a pentanol in an amount from about 10 vol. % to about 55 vol. %;

(b) a butanol in an amount from about 45 vol. % to about 90 vol. %;

(c) a propanol in an amount from 0 to about 5 vol. %;

(d) ethanol in an amount from 0 to about 3 vol. %; and (e) methanol in an amount from 0 to about 3 vol. %, wherein all amounts are based on the total volume of the fuel.

In another aspect, provided herein is a fuel additive comprising:

(a) a pentanol in an amount from about 10 vol. % to about 55 vol. %;

(b) a butanol in an amount from about 45 vol. % to about 90 vol. %;

(c) a propanol in an amount from 0 to about 5 vol. %;

(d) ethanol in an amount from 0 to about 3 vol. %; and (e) methanol in an amount from 0 to about 3 vol. %, wherein all amounts are based on the total volume of the fuel.

In another aspect, provided herein is a fuel composition comprising a fuel component and a fuel additive, wherein the fuel additive comprises:

(a) a pentanol in an amount from about 10 vol. % to about 55 vol. %;

(b) a butanol in an amount from about 45 vol. % to about 90 vol. %;

(c) a propanol in an amount from 0 to about 5 vol. %;

(d) ethanol in an amount from 0 to about 3 vol. %; and (e) methanol in an amount from 0 to about 3 vol. %, wherein all amounts are based on the total volume of the fuel additive.

In some embodiments, the pentanol disclosed herein is 1-pentanol, 2-pentanol, 3-pentanol, 3-methyl-1-butanol, 2-methyl-1-butanol, 2,2-dimethyl-1-propanol, 3-methyl-2-butanol, 2-methyl-2-butanol or a combination thereof. In certain embodiments, the butanol disclosed herein is n-butanol, isobutanol, sec-butanol, tert-butanol or a combination thereof. In some embodiments, the propanol disclosed herein is n-propanol, isopropanol or a combination thereof.

In certain embodiments, the amount of the pentanol disclosed herein is more than 15 vol. % or more than 30 vol. %, based on the total volume of the fuel.

In some embodiments, the fuels or fuel additives disclosed herein further comprise higher alcohols, wherein the higher alcohols comprise:

(a) a hexanol in an amount from 0.1 vol. % to 6 vol. %;

(b) a heptanol in an amount from 0.1 vol. % to 6 vol. %; and (c) an octanol in an amount from 0.1 vol. % to 6 vol. %, wherein all amounts are based on the total volume of the fuel.

In certain embodiments, the hexanol disclosed herein is 1-hexanol, 2-hexanol, 3-hexanol or a combination thereof. In certain embodiments, the heptanol disclosed herein is 1-heptanol, 2-heptanol, 3-heptanol, 4-heptanol or a combination thereof. In some embodiments, the octanol disclosed herein is 1-octanol, 2-octanol, 3-octanol, 4-octanol or a combination thereof.

In some embodiments, the fuels or fuel compositions disclosed herein further comprise a fuel additive selected from the group consisting of antioxidants, thermal stability improvers, cetane improvers, stabilizers, cold flow improvers, combustion improvers, anti-foams, anti-haze additives, corrosion inhibitors, lubricity improvers, icing inhibitors, injector cleanliness additives, smoke suppressants, drag reducing additives, metal deactivators, dispersants, detergents, demulsifiers, dyes, markers, static dissipaters, biocides and combinations thereof. In further embodiments, the fuel additive is substantially free of an oxygenate or other alcohols.

In certain embodiments, the fuels disclosed herein further comprise a fuel component. In certain embodiments, the fuel component in the fuels or fuel compositions disclosed herein is derived from petroleum or coal. In other embodiments, the fuel component is selected from the group consisting of diesel fuel, jet fuel, kerosene, gasoline, heating oil, fuel oil, bunker oil and combinations thereof. In some embodiments, the fuel component disclosed herein further comprises methanol, ethanol or a combination thereof.

In some embodiments, the fuel additive in the fuel compositions disclosed herein is from about 1 vol. % to about 35 vol. %, based on the total volume of the fuel composition.

DEFINITIONS

"Propanol" refers to a straight chain or branched compound having a molecular formula $C_3H_7OH$. In some embodiments, the propanol is n-propanol, isopropanol or a combination thereof.

"Butanol" refers to a straight chain or branched compound having a molecular formula $C_4H_9OH$. In some embodiments, the butanol disclosed herein is n-butanol, isobutanol, sec-butanol, tert-butanol or a combination thereof. In certain embodiments, the butanol comprises a mixture of stereoisomers, such as enantiomers and diastereoisomers.

"Pentanol" refers to a straight chain or branched compound having molecular formula $C_5H_{11}OH$. In some embodiments, the pentanol disclosed herein is 1-pentanol, 2-pentanol, 3-pentanol, 3-methyl-1-butanol, 2-methyl-1-butanol, 2,2-dimethyl-1-propanol, 3-methyl-2-butanol, 2-methyl-2-butanol or a combination thereof. In certain embodiments, the pentanol comprises a mixture of stereoisomers, such as enantiomers and diastereoisomers.

"Hexanol" refers to a straight chain or branched compound having a molecular formula $C_6H_{13}OH$. In some embodiments, the hexanol disclosed herein is 1-hexanol, 2-hexanol, 3-hexanol or a combination thereof. In certain embodiments, the hexanol comprises a mixture of stereoisomers, such as enantiomers and diastereoisomers.

"Heptanol" refers to a straight chain or branched compound having a molecular formula $C_7H_{15}OH$. In some embodiments, the heptanol disclosed herein is 1-heptanol, 2-heptanol, 3-heptanol, 4-heptanol or a combination thereof. In certain embodiments, the heptanol comprises a mixture of stereoisomers, such as enantiomers and diastereoisomers.

"Octanol" refers to a straight chain or branched compound having a molecular formula $C_8H_{17}OH$. In some embodiments, the octanol disclosed herein is 1-octanol, 2-octanol, 3-octanol, 4-octanol or a combination thereof. In certain embodiments, the octanol comprises a mixture of stereoisomers, such as enantiomers and diastereoisomers.

"Higher alcohol" refers to a straight chain or branched compound having a molecular formula $C_nH_{n+1}OH$, wherein n is from about 4 to about 100, from about 4 to about 50, from about 4 to about 20, from about 4 to about 15, from about 6 to about 12, or from 6 to about 10. In some embodiments, from 4 to about 10 or from 4 to about 8. In other embodiments, n is from 6 to about 8 or from 6 to about 10. In certain embodiments, the higher alcohol comprises a mixture of stereoisomers, such as enantiomers and diastereoisomers. In some embodiments, the higher alcohol disclosed herein comprises a mixture of straight chain or branched compounds, each having the molecular formula $C_nH_{n+1}OH$ as defined above. In certain embodiments, the fuel additive, fuel or fuel composition disclosed herein is substantially free of an higher alcohol having 6 or more carbon atoms. In some embodiments, the fuel additive, fuel or fuel composition disclosed herein is substantially free of an higher alcohol having 9 or more carbon atoms. In certain embodiments, the fuel additive, fuel or fuel composition disclosed herein is substantially free of hexanol, heptanol or octanol.

"Lower alcohol" refers to a compound having a molecular formula $C_nH_{n+1}OH$, wherein n is from 1 to 3. In some embodiments, the lower alcohol is methanol. In certain embodiments, the lower alcohol is ethanol. In some embodiments, the lower alcohol is propanol. In certain embodiments, the lower alcohol is a mixture of methanol and ethanol. In some embodiments, the lower alcohol is a mixture of methanol, ethanol and propanol. In certain embodiments, the fuel additive, fuel or fuel composition disclosed herein is substantially free of an lower alcohol. In some embodiments, the fuel additive, fuel or fuel composition disclosed herein is substantially free of methanol, ethanol or propanol. In certain embodiments, the fuel additive, fuel or fuel composition disclosed herein is substantially free of methanol and ethanol; methanol and propanol; propanol and ethanol; or methanol, ethanol and propanol.

"Fuel" refers to one or more alcohols, one or more hydrocarbons, one or more fatty esters, or a mixture thereof. In some embodiments, liquid alcohols are used. The fuel disclosed herein can be used to power internal combustion engines such as reciprocating engines (e.g., gasoline engines and diesel engines), Wankel engines, jet engines, some rocket engines, missile engines, and gas turbine engines. In some embodiments, the fuel comprises a mixture of alcohols such as butanol and pentanol.

"Fuel additive" refers to a minor fuel component such as chemical components added to fuels to alter the properties of the fuel, e.g., to improve engine performance, combustion efficiency, fuel handling, fuel stability, or for contaminant control. Types of additives include, but are not limited to, antioxidants, thermal stability improvers, cetane improvers, stabilizers, cold flow improvers, combustion improvers, antifoams, anti-haze additives, corrosion inhibitors, lubricity improvers, icing inhibitors, injector cleanliness additives, smoke suppressants, drag reducing additives, metal deactivators, dispersants, detergents, demulsifiers, dyes, markers, static dissipaters, biocides, and combinations thereof. The term "conventional additives" refers to fuel additives known to the skilled artisan, such as those described herein.

"Fuel composition" refers to a composition comprising one or more fuel components and one or more fuel additives.

"Fuel component" refers to any compound or a mixture of compounds that are used to formulate a fuel composition. There are "major fuel components" and "minor fuel components." A major fuel component is present in a fuel composition by at least 50% by volume; and a minor fuel component is present in a fuel composition by less than 50%. Fuel additives are minor fuel components. The mixture of butanol and pentanol disclosed herein can be a major component or a minor component, by themselves or in a mixture with other fuel components.

"Jet fuel" refers to a fuel suitable for use in a jet engine. In some embodiments, the jet fuel meets the specification for Jet A, Jet A-1 or Jet B as described in the ASTM D1655 specification, which is incorporated herein by reference.

"Kerosene" refers to a specific fractional distillate of petroleum (also known as "crude oil"), generally between 150° C. and 275° C. at atmospheric pressure. Petroleum generally comprises hydrocarbons of the paraffinic, naphthenic, and aromatic classes.

"Diesel fuel" refers to a fuel suitable for use in a diesel engine where the fuel is ignited by the heat of air under high compression. The class of diesel fuels includes hydrocarbons having a broad range of molecular weights. In some embodiments, the diesel fuels herein include hydrocarbons comprising at least 15 carbons. In other embodiments, the diesel fuels herein include hydrocarbons comprising at least 15 carbons, alcohols comprising at least 3 carbons, fatty esters comprising at least 10 carbons, and mixtures thereof. Types of diesel fuels include, but are not limited to, petrodiesel, biodiesel, bioengineered diesel, or mixtures thereof. Diesel fuels can also be obtained from synthetic fuels such as shale oil, or Fischer-Tropsch fuels such as those derived from synthetic gas and coal liquefaction.

"Gasoline" refers to a fuel suitable for use in a gasoline engine. In some embodiments, the gasoline meets one or more of the nine gasoline properties as specified in the ASTM D4814 specification for gasoline, which is incorporated herein by reference.

"Heating oil" or "fuel oil" refers to a fuel suitable for use in furnaces or boilers in buildings. In some embodiments, the heating oil meets the ASTM D396 specification, which is incorporated herein by reference.

"Bunker oil" refers to a fuel suitable for use in a ship engine. In some embodiments, the bunker oil meets the International Organization for Standardization (ISO) under number 8217, which is incorporated herein by reference.

"Flash point" refers to the lowest temperature at which the application of an ignition source causes vapors above the fuel to ignite under conditions described by the ASTM D93 specification.

"Cetane number" refers to a measure of how readily a fuel starts to burn (autoignite) under conditions described by the ASTM D 613 specification. A fuel with a high cetane number starts to burn shortly after it is injected into the cylinder; it has a short ignition delay period. Conversely, a fuel with a low cetane number resists autoignition and has a longer ignition delay period.

"Vapor pressure" or "Reid vapor pressure" of a fuel is a measure of the vapor pressure of the fuel in pounds per square inch at 100° F. It is an indication of the volatility of the fuel. Reid vapor pressure of a fuel can be measured according to the ASTM D 5191 specification.

"Research Octane Number" or "RON" refers to the octane number of a fuel determined by running the fuel through a specific test engine with a variable compression ratio under controlled conditions, and comparing these results with those for mixtures of isooctane and n-heptane. RON can be measured according to the ASTM D 2699 specification.

"Motor Octane Number" or "MON" refers to the octane number of a fuel determined by running the fuel through a similar test engine to that used in RON testing, but with a preheated fuel mixture, a higher engine speed, and variable ignition timing to further stress the fuel's knock resistance. Depending on the composition of the fuel, the MON of a modern gasoline generally is about 8 to 10 points lower than the RON. MON can be measured according to the ASTM D 2700 specification.

"Heat of combustion" of a compound is the energy released as heat when the compound undergoes complete combustion with oxygen. Heat of combustion of a liquid fuel can be measured according to the ASTM D4809-95 specification.

"Vapor-Liquid Ratio" or "V/L" of a fuel refers to the temperature at which the fuel forms a vapor-liquid ratio of 20 (V/L=20), i.e., the temperature at which it exists as 20 volumes of vapor in equilibrium with one volume of liquid at atmospheric pressure. The temperature for a V/L=20 varies with the season; the normal range is from about 35° C. (95° F.) to about 60° C. (140° F.). Generally, higher values provide greater protection against vapor lock and hot-fuel handling problems. Vapor-Liquid Ratio (V/L) of a liquid fuel can be measured according to the ASTM D 2533 or ASTM D 5188 specification.

A composition that is "substantially free" of a compound refers to a composition containing less than 20%, less than 10%, less than 5%, less than 4%, less than 3%, less than 2%, less than 1%, less than 0.5%, less than 0.1%, or less than 0.01% of the compound, based on the total volume or weight of the composition.

In the following description, all numbers disclosed herein are approximate values, regardless whether the word "about" or "approximate" is used in connection therewith. Numbers may vary by 1 percent, 2 percent, 5 percent, or, sometimes, 10 to 20 percent. Whenever a numerical range with a lower limit, $R^L$, and an upper limit, $R^U$, is disclosed, any number falling within the range is specifically disclosed. In particular, the following numbers within the range are specifically disclosed: $R=R^L+k*(R^U-R^L)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed.

DETAILED DESCRIPTION OF THE INVENTION

In one aspect, provided herein are fuels comprising:

(a) a pentanol in an amount from about 10 vol. % to about 55 vol. %;

(b) a butanol in an amount from about 45 vol. % to about 90 vol. %;

(c) a propanol in an amount from 0 to about 5 vol. %;

(d) ethanol in an amount from 0 to about 3 vol. %; and (e) methanol in an amount from 0 to about 3 vol. %, wherein all amounts are based on the total volume of the fuels.

In some embodiments, the fuels disclosed herein further comprise a conventional fuel component. In certain embodiments, the fuel component is derived from petroleum, coal, wood, the Fischer-Tropsch process or any other hydrocarbon sources. In certain embodiments, the fuel component is or comprises diesel fuel, jet fuel, kerosene, gasoline, heating oil, fuel oil, bunker oil or a combination thereof.

In certain embodiments, the fuels disclosed herein comprise one or more conventional fuel additives. The total amount of the fuel additives in the fuels disclosed herein is from about 0.001 wt. % to about 10 wt. %, based on the total weight of the fuel composition, and in one embodiment from about 0.01 wt. % to about 5 wt. %.

Some non-limiting examples of suitable fuel additives include oxygenates, antioxidants, thermal stability improvers, cetane improvers, stabilizers, cold flow improvers, combustion improvers, anti-foams, anti-haze additives, corrosion inhibitors, lubricity improvers, icing inhibitors, injector cleanliness additives, smoke suppressants, drag reducing additives, metal deactivators, dispersants, detergents, demulsifiers, dyes, markers, static dissipaters, biocides and combinations thereof. Some conventional fuel additives have been described in Maurice William Ranney, "*Fuel additives for internal combustion engines: Recent developments* (*Chemical technology review*)," Noyes Data Corp. (1978); and "*Gasoline: Additives, Emissions, and Performance*" by Society of Automotive Engineers, SAE International, 1995 (ISBN: 1560916451), both of which are incorporated herein by reference in their entirety.

In certain embodiments, the amount of each of the conventional fuel additives in the fuel or fuel composition disclosed herein is from about 0.1% to about 50%, from about 0.2% to about 40%, from about 0.3% to about 30%, from about 0.4% to about 20%, from about 0.5% to about 15% or from about 0.5% to about 10%, based on the total weight or volume of the fuel. In certain embodiments, the amount of each of the conventional fuel additives is less than about 50%, less than about 45%, less than about 40%, less than about 35%, less than about 30%, less than about 25%, less than about 20%, less than about 15%, less than about 10%, less than about 5%, less than about 4%, less than about 3%, less than about 2%, less than about 1% or less than about 0.5%, based on the total weight or volume of the the fuel or fuel composition.

In some embodiments, the fuels or fuel compositions disclosed herein comprise one or more oxygenates. Any oxygenate that increases the weight % of oxygen in fuels can be used herein. Generally, oxygenates are combustible liquids comprises carbon, hydrogen and oxygen that can be categorized into two classes of organic compounds, i.e., alcohols and ethers. Some non-limiting examples of suitable oxygenates include ethanol, methyl tertiary-butyl ether (MTBE), tertiary-amyl methyl ether (TAME), and ethyl tertiary-butyl ether (ETBE). In certain embodiments, the fuels or fuel compositions disclosed herein do not contain MTBE, TAME, ETBE or other oxygenates. In other embodiments, the fuels or fuel compositions disclosed herein is substantially free of an oxygenate. In other embodiments, the fuels or fuel compositions disclosed herein is substantially free of an ether or an alcohol, wherein the alcohol is not methanol, ethanol, propanol, butanol, pentanol, hexanol, heptanol, octanol or a combination thereof.

In certain embodiments, the fuels or fuel compositions disclosed herein comprise one or more lubricity improvers or enhancers. Any lubricity improver that can increase the fuel lubricity can be used herein. In some embodiments, one or more lubricity improvers are mixed with the fuel disclosed herein. In certain embodiments, the concentration of the lubricity improver in the fuel is from about 1 ppm to about 50,000 ppm, from about 10 ppm to about 20,000 ppm, from about 25 ppm to 10,000 ppm, or from about 50 ppm and 1000 ppm, based on the total weight of the fuel or fuel composition. Some non-limiting examples of suitable lubricity improvers include esters of fatty acids such as glycerol monooleate and di-isodecyl adipate; amide-based additives such as those available from the Lubrizol Chemical Company (e.g., LZ 539 C); dimerised linoleic acid; aminoalkylmorpholines; dithiophosphoric diester-dialcohols; and alkyl aromatic compounds having at least one carboxyl group. Some suitable lubricity improvers or enhancers are described in patent literature such as WO 95/33805; WO 94/17160; WO 98/01516; and U.S. Pat. Nos. 5,484,462 and 5,490,864; and in the paper by Danping Wei and H. A. Spikes, "The Lubricity of Diesel Fuels", Wear, III (1986) 217 235, all of which are incorporated herein by reference. Some non-limiting examples of commercially available lubricity improvers include OLI 9000 (from Octel Corporation, Manchester, UK), PARADYNE™ 655 and VEKTRON™ 6010 (from Infineum, Linden, N.J.), and HITEC™ E580 (from Ethyl Corporation, Richmond, Va.).

In some embodiments, the fuels or fuel compositions disclosed herein comprise one or more stabilizers. Any stabilizer that can improve the storage stability of fuels can be used herein. Some non-limiting examples of stabilizers include tertiary alkyl primary amines. In certain embodiments, the stabilizer is at a concentration from about 0.001 wt. % to about 2 wt. %, based on the total weight of the fuel or fuel composition, and in one embodiment from about 0.01 wt. % to about 1 wt. %.

In certain embodiments, the fuels or fuel compositions disclosed herein comprise one or more combustion improvers. Any combustion improver that can increase the mass burning rate of fuels can be used herein. Some non-limiting examples of combustion improvers include ferrocene(dicyclopentadienyl iron), iron-based combustion improvers (e.g., TURBOTECT™ ER-18 from Turbotect (USA) Inc., Tomball, Tex.), barium-based combustion improvers, cerium-based combustion improvers, and iron and magnesium-based combustion improvers (e.g., TURBOTECT™ 703 from Turbotect (USA) Inc., Tomball, Tex.). In some embodiments, the combustion improver is at a concentration from about 0.001 wt. % to about 1 wt %, based on the total weight of the fuel or fuel composition, and in one embodiment from about 0.01 wt. % to about 1 wt. %.

In some embodiments, the fuels or fuel compositions disclosed herein comprise one or more antioxidants. Any antioxidant that can prevent the formation of gum depositions on fuel system components caused by oxidation of fuels in storage and/or inhibit the formation of peroxide compounds in fuels can be used. In some embodiments, the antioxidant is at a concentration from about 0.001 wt. % to about 5 wt. %, based on the total weight of the fuel or fuel composition, and in one embodiment from about 0.01 wt. % to about 1 wt. %.

In certain embodiments, the fuels or fuel compositions disclosed herein comprise one or more static dissipaters. Any static dissipater that can reduce the effects of static electricity generated by movement of fuel through high flow-rate fuel transfer systems can be used herein. In some embodiments, the static dissipater is at a concentration from about 0.001 wt. % to about 5 wt. %, based on the total weight of the fuel or fuel composition, and in one embodiment from about 0.01 wt. % to about 1 wt. %.

In some embodiments, the fuels or fuel compositions disclosed herein comprise one or more corrosion inhibitors. Any corrosion inhibitor that can protect ferrous metals in fuel handling systems such as pipelines, and fuel storage tanks, from corrosion can be used herein. In circumstances where additional lubricity is desired, corrosion inhibitors that also improve the lubricating properties of the composition can be used. In some embodiments, the corrosion inhibitor is at a concentration from about 0.001 wt. % to about 5 wt. %, based on the total weight of the fuel or fuel composition, and in one embodiment from about 0.01 wt. % to about 1 wt. %.

In certain embodiments, the fuels or fuel compositions disclosed herein comprise one or more icing inhibitors (aka anti-icing additives). Any icing inhibitor that can reduce the freezing point of water precipitated from fuels due to cooling at high altitudes and prevent the formation of ice crystals which restrict the flow of fuel to the engine can be used herein. In some embodiments, the icing inhibitor is at a concentration from about 0.001 wt. % to about 5 wt. %, based on the total weight of the fuel or fuel composition, and in one embodiment from about 0.01 wt. % to about 1 wt. %.

In some embodiments, the fuels or fuel compositions disclosed herein comprise one or more biocides. Any biocides that can combat microbial growth in fuels can be used herein. In some embodiments, the biocide is at a concentration from about 0.001 wt. % to about 5 wt. %, based on the total weight of the fuel or fuel composition, and in one embodiment from about 0.01 wt. % to about 1 wt. %.

In certain embodiments, the fuels or fuel compositions disclosed herein comprise one or more metal deactivators. Any metal deactivator that can suppress the catalytic effect of some metals, particularly copper, on fuel oxidation can be used herein. In some embodiments, the metal deactivator is at a concentration from about 0.001 wt. % to about 5 wt. %, based on the total weight of the fuel or fuel composition, and in one embodiment from about 0.01 wt. % to about 1 wt. %.

In some embodiments, the fuels or fuel compositions disclosed herein comprise one or more thermal stability improvers. Any thermal stability improver that can inhibit deposit formation in the high temperature areas of aircraft fuel systems can be used herein. In some embodiments, the thermal stability improver is at a concentration from about 0.001 wt. % to about 5 wt. %, based on the total weight of the fuel or fuel composition, and in one embodiment from about 0.01 wt. % to about 1 wt. %.

In certain embodiments, the fuels or fuel compositions disclosed herein comprise one or more detergents. Generally, the amount of the detergent additive is less than 10,000 ppm, less than 1000 ppm, less than 100 ppm, or less than 10 ppm, based on the total weight of the fuel or fuel composition. Some non-limiting examples of suitable detergents include polyolefin substituted succinimides or succinamides of polyamines, for instance polyisobutylene succinimides or polyisobutylene amine succinamides, aliphatic amines, Mannich bases or amines, and polyolefin (e.g. polyisobutylene) maleic anhydrides. Some suitable succinimide detergents are described in GB960493, EP0147240, EP0482253, EP0613938, EP0557561, and WO 98/42808, all of which are incorporated herein by reference. In some embodiments, the detergent is a polyolefin substituted succinimide such as polyisobutylene succinimide. Some non-limiting examples of commercially available detergent additives include F7661 and F7685 (from Infineum, Linden, N.J.) and OMA 4130D (from Octel Corporation, Manchester, UK).

In some embodiments, the fuels or fuel compositions disclosed herein comprise one or more cetane improvers. Some non-limiting examples of cetane improvers include peroxides, nitrates, nitrites, azo compounds and the like. Alkyl nitrates such as amyl nitrate, hexyl nitrate and mixed octyl nitrates, 2-methyl-2-nitropropyl nitrate, and 2-ethylhexyl nitrate can be used. In some embodiments, the cetane improver is 2-ethylhexyl nitrate which is commercially available from the Associated Octel Company Limited under the brand name C1-0801. In certain embodiments, the cetane improver is at a concentration from about 0.001 wt. % to about 5 wt. %, based on the total weight of the fuel or fuel composition, and in one embodiment from about 0.01 wt. % to about 2.5 wt. %.

In another aspect, provided herein are fuel additives comprising:

(a) a pentanol in an amount from about 10 vol. % to about 55 vol. %;
(b) a butanol in an amount from about 45 vol. % to about 90 vol. %;
(c) a propanol in an amount from 0 to about 5 vol. %;
(d) ethanol in an amount from 0 to about 3 vol. %; and
(e) methanol in an amount from 0 to about 3 vol. %, wherein all amounts are based on the total volume of the fuel additives.

In another aspect, provided herein are fuel compositions comprising a fuel component and a fuel additive, wherein the fuel additive comprises:

(a) a pentanol in an amount from about 10 vol. % to about 55 vol. %;
(b) a butanol in an amount from about 45 vol. % to about 90 vol. %;
(c) a propanol in an amount from 0 to about 5 vol. %;
(d) ethanol in an amount from 0 to about 3 vol. %; and
(e) methanol in an amount from 0 to about 3 vol. %, wherein all amounts are based on the total volume of the fuel additive.

In some embodiments, the fuel additive disclosed herein in the fuel compositions disclosed herein is from about 0.1 vol. % to about 50 vol. %, from about 0.25 vol. % to about 45 vol. %, from about 0.5 vol. % to about 40 vol. %, from about 0.75 vol. % to about 35 vol. %, from about 1 vol. % to about 35 vol. %, from about 1 vol. % to about 30 vol. %, from about 1 vol. % to about 25 vol. %, from about 1 vol. % to about 20 vol. %, from about 2.5 vol. % to about 35 vol. %, from about 5 vol. % to about 35 vol. %, from about 10 vol. % to about 35 vol. %, from about 15 vol. % to about 35 vol. %, or from about 20 vol. % to about 35 vol. %, based on the total volume of the fuel composition.

In certain embodiments, the fuel compositions disclosed herein further comprise at least one conventional fuel additive as disclosed herein in an amount as disclosed herein. However, the fuel additive disclosed herein can be used as an oxygenate to provide for increased combustion efficiency.

In some embodiments, the fuel component in the fuel compositions disclosed herein is derived from petroleum, coal, wood, the Fischer-Tropsch process or any other hydrocarbon sources such as starch and sugars. Some non-limiting suitable examples of the fuel component is diesel fuel, jet fuel, kerosene, gasoline, heating oil, fuel oil, bunker oil or a combination thereof. In some embodiments, the fuel component is derived from petroleum or coal. In certain embodiments, the fuel component further comprises methanol, ethanol or a combination thereof. In other embodiments, the fuel component further comprises methanol, ethanol, one or more higher alcohols or a combination thereof.

In certain embodiments, the amount of the fuel component in the fuel or fuel composition disclosed herein is at least 10%, at least 20%, at least 30%, at least 40%, at least 50%, at least 60%, at least 70%, at least 80%, or at least 90%, based on the total weight or volume of the fuel or fuel composition disclosed herein. In some embodiments, the amount of the fuel component is at most 10%, at most 20%, at most 30%, at most 40%, at most 50%, at most 60%, at most 70%, at most 80%, or at most 90%, based on the total weight or volume of the fuel or fuel composition disclosed herein. In certain embodiments, the amount of the fuel component is from about 10% to about 90%, from about 10% to about 80%, from about 10% to about 70%, from about 10% to about 60%, from about 10% to about 50%, from about 10% to about 40%, from about 10% to about 30%, or from about 10% to about 20%, based on the total weight or volume of the fuel or fuel composition disclosed herein. In some embodiments, the amount of the fuel component is from about 20% to about 90%, from about 30% to about 90%, from about 40% to about 90%, from about 50% to about 90%, from about 60% to about 90%, from about 70% to about 90%, or from about 80% to about 90%, based on the total weight or volume of the fuel or fuel composition disclosed herein.

In some embodiments, the amount of the pentanol in the fuel or fuel additive disclosed herein is more than 5%, more than 9%, more than 10%, more than 15%, more than 16%, more than 20%, more than 25%, more than 30%, more than 31%, more than 35 vol. %, more than 40 vol. %, or more than 45 vol. %, based on the total weight or volume of the fuel or fuel additive. In some embodiments, the amount of the pentanol in the fuel or fuel additive disclosed herein is less than 50%, less than 55%, less than 60%, less than 70%, less than 80%, or less than 90%, based on the total weight or volume of the fuel or fuel additive. In certain embodiments, the amount of the pentanol in the fuel or fuel additive disclosed herein is from about 10% to about 55%, from about 10% to about 60%, from about 10% to about 65%, from about 10% to about 70%, from about 10% to about 75%, from about 10% to about 80%, from about 10% to about 85%, or from about 10% to about 90%, based on the total weight or volume of the fuel or fuel additive. In some embodiments, the amount of the pentanol in the fuel or fuel additive disclosed herein is from about 15% to about 55%, from about 16% to about 55%, from about 20% to about 55%, from about 25% to about 55%, from about 30% to about 55%, from about 31% to about 55%, or from about 35% to about 55%, based on the total weight or volume of the fuel or fuel additive.

In certain embodiments, the amount of the butanol in the fuel or fuel additive disclosed herein is more than 5%, more than 10%, more than 11%, more than 15%, more than 20%, more than 25%, more than 30%, more than 35 vol. %, more than 40 vol. %, or more than 45 vol. %, based on the total weight or volume of the fuel or fuel additive. In some embodiments, the amount of the butanol in the fuel or fuel additive disclosed herein is less than 50%, less than 55%, less than 60%, less than 70%, less than 80%, or less than 90%, based on the total weight or volume of the fuel or fuel additive. In certain embodiments, the amount of the butanol in the fuel or fuel additive disclosed herein is from about 45% to about 90%, from about 45% to about 95%, from about 40% to about 90%, from about 35% to about 90%, from about 30% to about 90%, from about 25% to about 90%, from about 20% to about 90%, from about 15% to about 90%, or from about 10% to about 90%, based on the total weight or volume of the fuel or fuel additive.

In some embodiments, the amounts of the butanol and pentanol in the fuel or fuel additive disclosed herein are respectively from about 45 vol. % to about 90 vol. % and from about 10 vol. % to about 55 vol. %, based on the total volume of the fuel or fuel additive. In certain embodiments, the amounts of the butanol and pentanol in the fuel or fuel additive disclosed herein are respectively from about 40 vol. % to about 90 vol. % and from about 10 vol. % to about 55 vol. %, based on the total volume of the fuel or fuel additive. In some embodiments, the amounts of the butanol and pentanol in the fuel or fuel additive disclosed herein are respectively from about 35 vol. % to about 90 vol. % and from about 10 vol. % to about 55 vol. %, based on the total volume of the fuel or fuel additive. In certain embodiments, the total amount of the butanol and pentanol in the fuel or fuel additive disclosed herein is more than 60 vol. %, more than 65 vol. %, more than 70 vol. %, more than 75 vol. %, more than 80 vol. %, more than 85 vol. %, or more than 90 vol. %, based on the total volume of the fuel or fuel additive.

In certain embodiments, the amount of the propanol in the fuel or fuel additive disclosed herein is less than 10 vol. %, less than 5 vol. %, less than 3 vol. %, less than 2 vol. %, less than 1 vol. %, less than 0.5 vol. %, less than 0.1 vol. %, or less than 0.01 vol. %, based on the total volume of the fuel or fuel additive. In certain embodiments, the amount of the propanol in the fuel or fuel additive disclosed herein is from 0 to about 10%, from 0 to less than 10%, from 0 to about 9%, from 0 to about 8%, from 0 to about 7%, from 0 to about 6%, from 0 to about 5%, from 0 to about 4%, from 0 to about 3%, from 0 to about 2%, from 0 to about 1%, from 0 to about 0.5%, from 0 to about 0.1%, based on the total weight or volume of the fuel or fuel additive. In some embodiments, the fuel or fuel additive disclosed herein is substantially free of propanol.

In some embodiments, the amount of the ethanol in the fuel or fuel additive disclosed herein is less than 40 vol. %, less than 30 vol. %, less than 20 vol. %, less than 10 vol. %, less than 5 vol. %, less than 4 vol. %, less than 3 vol. %, less than 2 vol. %, less than 1 vol. %, less than 0.5 vol. %, less than 0.1 vol. %, or less than 0.01 vol. %, based on the total volume of the fuel or fuel additive. In certain embodiments, the amount of the ethanol in the fuel or fuel additive disclosed herein is from 0 to about 5%, from 0 to about 4%, from 0 to about 3%, from 0 to about 2%, from 0 to about 1%, from 0 to about 0.5%, from 0 to about 0.1%, based on the total weight or volume of the fuel or fuel additive. In some embodiments, the fuel or fuel additive disclosed herein is substantially free of ethanol.

In certain embodiments, the amount of the methanol in the fuel or fuel additive disclosed herein is less than 4 vol. %, less than 3 vol. %, less than 2 vol. %, less than 1 vol. %, less than 0.5 vol. %, less than 0.1 vol. %, or less than 0.01 vol. %, based on the total volume of the fuel or fuel additive. In certain embodiments, the amount of the methanol in the fuel or fuel additive disclosed herein is from 0 to about 10%, from 0 to about 9%, from 0 to about 8%, from 0 to about 7%, from 0 to about 6%, from 0 to about 5%, from 0 to about 4%, from 0 to about 3%, from 0 to about 2%, from 0 to about 1%, from 0 to less than 1%, from 0 to about 0.5%, from 0 to about 0.1%, based on the total weight or volume of the fuel or fuel additive. In some embodiments, the fuel or fuel additive disclosed herein is substantially free of methanol.

In some embodiments, the fuel or fuel additive disclosed herein further comprises one or more higher alcohols, each having 6 or more carbon atoms. In further embodiments, the one or more higher alcohols comprise hexanol, heptanol, octanol or a combination thereof. In certain embodiments, the amounts of the hexanol, heptanol and octanol in the fuel or fuel additive disclosed herein are respectively from about 0.1% to about 6%, from about 0.1% to about 6%, and from about 0.1% to about 6%, based on the total weight or volume of the fuel or fuel additive. In some embodiments, the amounts of the hexanol, heptanol and octanol in the fuel or fuel additive disclosed herein are respectively from about 0.1% to about 10%, from about 0.1% to about 6%, and from about 0.1% to about 6%, based on the total weight or volume of the fuel or fuel additive.

In certain embodiments, the amount of the hexanol in the fuel or fuel additive disclosed herein is less than 10 vol. %, less than 8 vol. %, less than 6 vol. %, less than 5 vol. %, less than 3 vol. %, less than 2 vol. %, less than 1 vol. %, less than 0.5 vol. %, less than 0.1 vol. %, or less than 0.01 vol. %, based on the total volume of the fuel or fuel additive. In certain embodiments, the amount of the hexanol in the fuel or fuel additive disclosed herein is from about 0.1% to about 15%, from about 0.1% to about 10%, from about 0.1% to about 9%, from about 0.1% to about 8%, from about 0.1% to about 7%, from about 0.1% to about 6%, from 0 to about 6%, from about 0.1% to about 5%, from about 0.1% to about 4%, from about 0.1% to about 3%, from about 0.1% to about 2%, from about 0.1% to about 1%, or from about 0.01% to about 0.5%, based on the total weight or volume of the fuel or fuel additive. In some embodiments, the fuel or fuel additive disclosed, herein is substantially free of hexanol.

In some embodiments, the amount of the heptanol in the fuel or fuel additive disclosed herein is less than 10 vol. %, less than 8 vol. %, less than 6 vol. %, less than 5 vol. %, less than 3 vol. %, less than 2 vol. %, less than 1 vol. %, less than 0.5 vol. %, less than 0.1 vol. %, or less than 0.01 vol. %, based on the total volume of the fuel or fuel additive. In certain embodiments, the amount of the heptanol in the fuel or fuel additive disclosed herein is from about 0.1% to about 10%, from about 0.1% to about 9%, from about 0.1% to about 8%, from about 0.1% to about 7%, from about 0.1% to about 6%, from 0 to about 6%, from about 0.1% to about 5%, from about 0.1% to about 4%, from about 0.1% to about 3%, from about 0.1% to about 2%, from about 0.1% to about 1%, or from about 0.01% to about 0.5%, based on the total weight or volume of the fuel or fuel additive. In some embodiments, the fuel or fuel additive disclosed herein is substantially free of heptanol.

In certain embodiments, the amount of the octanol in the fuel or fuel additive disclosed herein is less than 10 vol. %, less than 8 vol. %, less than 6 vol. %, less than 5 vol. %, less than 3 vol. %, less than 2 vol. %, less than 1 vol. %, less than 0.5 vol. %, less than 0.1 vol. %, or less than 0.01 vol. %, based on the total volume of the fuel or fuel additive. In certain embodiments, the amount of the octanol in the fuel or fuel additive disclosed herein is from about 0.1% to about 10%, from about 0.1% to about 9%, from about 0.1% to about 8%, from about 0.1% to about 7%, from about 0.1% to about 6%, from 0 to about 6%, from about 0.1% to about 5%, from about 0.1% to about 4%, from about 0.1% to about 3%, from about 0.1% to about 2%, from about 0.1% to about 1%, or from about 0.01% to about 0.5%, based on the total weight or volume of the fuel or fuel additive. In some embodiments, the fuel or fuel additive disclosed herein is substantially free of octanol.

In some embodiments, the amounts of the methanol, ethanol and propanol in the fuel or fuel additive disclosed herein are respectively from 0 to about 3%, from 0 to about 3%, and from 0 to about 5%, based on the total weight or volume of the fuel or fuel additive. In other embodiments, the amounts of the methanol, ethanol, propanol, hexanol, heptanol and octanol in the fuel or fuel additive disclosed herein are respectively from 0 to about 3%, from 0 to about 3%, from 0 to about 5%, from about 0.1% to about 6%, from about 0.1% to about 6%, and from about 0.1% to about 6%, based on the total weight or volume of the fuel or fuel additive.

In certain embodiments, the total amount of the methanol, ethanol and propanol in the fuel or fuel additive disclosed herein is less than 20 vol. %, less than 15 vol. %, less than 10 vol. %, less than 9 vol. %, less than 8 vol. %, less than 7 vol. %, less than 5 vol. %, less than 4 vol. %, less than 3 vol. %, less than 2 vol. %, or less than 1 vol. %, based on the total volume of the fuel or fuel additive. In some embodiments, the total amount of the hexanol, heptanol and octanol in the fuel or fuel additive disclosed herein is less than 20 vol. %, less than 15 vol. %, less than 10 vol. %, less than 9 vol. %, less than 8 vol. %, less than 7 vol. %, less than 5 vol. %, less than 4 vol. %, less than 3 vol. %, less than 2 vol. %, or less than 1 vol. %, based on the total volume of the fuel or fuel additive. In other embodiments, the total amount of the methanol, ethanol, propanol, hexanol, heptanol and octanol in the fuel or fuel additive disclosed herein is less than 20 vol. %, less than 15 vol. %, less than 10 vol. %, less than 9 vol. %, less than 8 vol. %, less than 7 vol. %, less than 5 vol. %, less than 4 vol. %, less than 3 vol. %, less than 2 vol. %, or less than 1 vol. %, based on the total volume of the fuel or fuel additive.

The fuels or fuel compositions disclosed herein can be used to power any equipment such as an emergency generator or internal combustion engine, which requires a fuel such as diesel fuel, jet fuel, kerosene or gasoline. Some non-limiting examples of internal combustion engines include reciprocating engines (e.g., gasoline engines and diesel engines), Wankel engines, jet engines, some rocket engines, and gas turbine engines.

The fuels or fuel compositions disclosed herein can also be used to as heating oils, fuel oils or bunker oils for furnaces, boilers or gasifiers. In certain embodiments, provided are emergency fuels comprising one or more of the above fuels or fuel compositions. In certain embodiments, provided herein are uses of the above fuel compositions as emergency fuels. The term "emergency fuel" refers to a fuel which is generally stored in a container other than the gas tank of a vehicle. The fuel should be stable over an extended period of time, for example, six to twelve months. When the vehicle runs out of fuel, the emergency fuel is added to the gas tank of the vehicle and provides fuel to the vehicle. Because the flash point of fuels or fuel compositions disclosed herein is from about 54° F. to about 178° F., they can be safely stored in the trunk of a vehicle.

In some embodiments, the fuel additives, fuels or fuel compositions disclosed herein are intended for use in diesel engines. According to the ASTM D975 specification, diesel fuels are categorized into seven grades suitable for various types of diesel engines. The seven grades are: Grade No. 1-D S15; Grade No. 1-D S500; Grade No. 1-D S5000; Grade No. 2-D S15; Grade No. 2-D S500; Grade No. 2-D S5000; and Grade No. 4-D. In some embodiments, the fuels or fuel compositions disclosed herein meet the ASTM D 975 specification for Grade No. 1-D S15, 1-D S500, 1-D S5000, 2-D S15, 2-D S500, 2-D S5000, or No. 4-D. The ASTM D975 specification is incorporated herein by reference.

In certain embodiments, the fuel additives, fuels or fuel compositions disclosed herein are intended for use in jet engines. The most common jet fuel is Jet A-1, which is produced to an internationally standardized set of specifications. In the United States only, a version of Jet A-1 known as Jet A is also used. Another jet fuel that is commonly used in civilian aviation is Jet B. Jet B is a lighter fuel that is used for its enhanced cold-weather performance. Jet A, Jet A-1, and Jet B are specified in the ASTM D1655 specification. Alternatively, jet fuels are classified by militaries around the world with a system of JP numbers. Some are almost identical to their civilian counterparts and differ only by the amounts of a few additives. For example, Jet A-1 is similar to JP-8 and Jet B is similar to JP-4. In some embodiments, the fuels or fuel compositions disclosed herein meet the ASTM D1655 specification for Jet A, Jet A-1, and Jet B. The ASTM D1655 specification is incorporated herein by reference.

In some embodiments, the fuel additives, fuels or fuel compositions disclosed herein are intended for use in spark-ignition gasoline engines. Various characteristics and requirements of gasoline fuels for use over a wide range of operating conditions in spark-ignition gasoline engines are described in the ASTM D4814 specification. In some embodiments, the fuels or fuel compositions disclosed herein meet the ASTM D4814 specification for gasoline fuels. The ASTM D4814 specification is incorporated herein by reference.

In certain embodiments, the fuel additives, fuels or fuel compositions disclosed herein are intended for use as marine bunker fuels or bunker oils in ship engines. Various characteristics and requirements of bunker oil for use in ship engines are described in the ISO 8217 specification. In some embodiments, the fuels or fuel compositions disclosed herein meet the ISO 8217 specification for bunker oils. The ISO 8217 specification is incorporated herein by reference.

In some embodiments, the fuel additives, fuels or fuel compositions disclosed herein are intended for use as heating or fuel oils in furnaces or boilers in buildings. Various grades of fuel or heating oil intended for use in various types of fuel-oil-burning equipment under various climatic and operating conditions are described in the ASTM D396 specification. These grades include the following: Grades No. 1 S5000, No. 1 S500, No. 2 S5000, and No. 2 S500 for use in domestic and small industrial burners; Grades No. 1 S5000 and No. 1 S500 adapted to vaporizing type burners or where storage conditions require low pour point fuel; Grades No. 4 (Light) and No. 4 (Heavy) for use in commercial/industrial burners; and Grades No. 5 (Light), No. 5 (Heavy), and No. 6 for use in industrial burners. In some embodiments, the fuels or fuel compositions disclosed herein meet the ASTM D396 specification for Grade No. 1 S5000, No. 1 S500, No. 2 S5000, No. 2 S500, No. 1 S5000, No. 1 S500 No. 4 (Light), No. 4 (Heavy), No. 5 (Light), No. 5 (Heavy), or No. 6 fuel or heating oil. The ASTM D396 specification is incorporated herein by reference.

In some embodiments, the fuels or fuel compositions disclosed herein have a cetane number of at least about 40, at least about 45, at least about 50, at least about 55, at least about 60, at least about 65, or at least about 70. In certain embodiments, the fuels or fuel compositions disclosed herein have a cetane number from about 40 to about 90, from about 45 to about 80, or from about 50 to about 70. The cetane number of the fuels or fuel compositions disclosed herein can be measured by the ASTM D4737 specification, which is incorporated herein by reference.

In certain embodiments, the fuels or fuel compositions disclosed herein have a cloud point that is at most 0° C., at most −5° C., at most −10° C., at most −15° C., at most −20° C., or at most −25° C. The cloud point of the fuels or fuel compositions disclosed herein can be measured by the ASTM D2500 specification, which is incorporated herein by reference.

In some embodiments, the fuel additives, fuels and fuel compositions disclosed herein can be used without any changes to a gasoline engine operation and timing. In other embodiments, the fuel additives, fuels and fuel compositions disclosed herein can be used with no changes or only minor changes to other currently operating engines (e.g., diesel engines, jet fuel engines and gasoline engines) and combustion devices and these minor changes can be done quickly, inexpensively and without inconvenience. In certain embodiments, the fuel additives, fuels and fuel compositions disclosed herein can be safely introduced into the current fuel distribution network.

In certain embodiments, the fuel additives, fuels and fuel compositions disclosed herein is soluble in diesel fuel and does not impair the cetane level of diesel fuel to the same extent as methanol or ethanol would, and has much more compatible vapor pressure ratings that allow blending with diesel fuel.

In some embodiments, when a fuel additive disclosed herein is added to gasoline, diesel fuel or jet fuel and combusted in an internal combustion engine, it reduces the emissions of the greenhouse gas carbon dioxide and pollutants including particulates, carbon monoxide, sulfur dioxide and unburned hydrocarbons while not significantly increasing the formation of nitrous oxides.

In certain embodiments, when a fuel additive disclosed herein is added to fuel oils for furnaces, boilers or gasifiers that combust such fuel oils, it reduces the emissions of the greenhouse gas carbon dioxide and pollutants including particulates, carbon monoxide, nitrous oxide, sulfur dioxide and unburned hydrocarbons.

In some embodiments, the fuel additives, fuels and fuel compositions disclosed herein provide for a cleaner burning fuel blend that reduces smog particulates in gasoline, diesel or jet fuels.

In certain embodiments, the fuel additives, fuels and fuel compositions disclosed herein increase gas mileage of internal combustion engines when blended with gasoline.

In some embodiments, the fuel additives disclosed herein when combined with gasoline provide a low Reid Vapor Pressure. The combustion of such gasoline fuel can produce lower quantities of sulfur, nitrogen and particulate matter when compared to ethanol or other currently used fuel additives which can pollute air, water and land environments.

In certain embodiments, when a fuel additive disclosed herein is added to diesel fuel, it reduces the soot and smoke given off during combustion, as well as the amount of smog particulates.

In some embodiments, the fuels and fuel compositions disclosed herein can be used as higher Btu alcohol fuels which reduce land and water pollution as they feature higher combustion efficiencies with lower environmental impact per unit of power output In certain embodiments, the fuel additives, fuels and fuel compositions disclosed herein have low solubility in water and are biodegradable.

The fuel or fuel additive disclosed herein can be prepared by a thermochemical and catalytical process for converting a carbon bearing feedstock to a syngas, and for converting the syngas into a mixture comprising higher alcohols. The production facility comprises at least the following units: a unit for syngas generation, a unit for syngas conditioning, a unit for higher alcohol synthesis, and a unit for product separation.

In some embodiments, the fuel or fuel additive disclosed herein can be prepared by a method comprising the steps of:

(a) converting a carbon bearing feedstock to a syngas comprising hydrogen and carbon monoxide;

(b) adjusting the ratio of hydrogen and carbon monoxide in the syngas;

(c) converting the syngas in the presence of a catalyst and under a condition to form a fuel or fuel additive comprising:

i. a pentanol in an amount from about 10 vol. % to about 55 vol. %;

ii. a butanol in an amount from about 45 vol. % to about 90 vol. %;

iii. a propanol in an amount from 0 to about 5 vol. %;

iv. ethanol in an amount from 0 to about 3 vol. %; and v. methanol in an amount from 0 to about 3 vol. %, wherein all amounts are based on the total volume of the fuels.

In some embodiments, the carbon bearing feedstock is a solid feedstock such as coal, biomass, wood pellets and chips, a carbon containing waste, any organic or fossil based carbonaceous material or a combination thereof. The solid feedstock can be in any size, shape, bulk density, moisture content, energy content, chemical composition, ash fusion characteristics, and homogeneity that are suitable for gasification. Any gasification process or gasifier that can convert a solid feedstock into carbon monoxide, hydrogen, carbon dioxide, methane or a combination thereof can be used herein. In some embodiments, the gasification temperature is greater than about 500° C., greater than about 600° C., greater than about 700° C., greater than about 800° C., greater than about 900° C. or greater than about 1000° C. with a controlled amount of oxygen and/or steam. Some non-limiting examples of suitable gasifier include counter-current fixed bed gasifier, co-current fixed bed gasifier, fluidized bed reactor, entrained flow gasifier and plasma gasifier.

In certain embodiments, the carbon bearing feedstock is a gas or liquid feedstock such as natural gas, gas hydrocarbons or liquid hydrocarbons. Any gasification method that can convert a gas or liquid feedstock into syngas can be used herein. Some non-limiting examples of such gasification method include steam reforming, auto-thermal reforming and partially oxidation technology.

In some embodiments, the adjustment of the ratio of hydrogen and carbon monoxide in the syngas can be done by a water-gas shift reactor or a hydrogen membrane. Any water-gas shift reaction that converts carbon monoxide and water vapor to form carbon dioxide and hydrogen can be used herein. The water-gas shift reaction can be carried out in two stages. In certain embodiments, the reaction temperature of the first stage is at about 300° C., about 350° C. or about 400° C. In certain embodiments, the reaction temperature of the second stage is from about 150 to about 250° C., from about 175 to about 230° C. or from about 190 to about 210° C. Some non-limiting examples of suitable catalyst for the water-gas shift reaction include iron oxide promoted with chromium oxide for the first stage and copper on a mixed support composed of zinc oxide and aluminum oxide for the second stage. Other non-limiting examples of suitable catalyst include Fe3O4 (magnetite), transition metals and transition metal oxides, and Raney copper catalyst.

In certain embodiments, the ratio of hydrogen and carbon monoxide in the syngas is adjusted to be or is from about 100:1 to about 1:100, from about 50:1 to about 1:50, from about 40:1 to about 1:40, from about 30:1 to about 1:30, from about 20:1 to about 1:20, from about 15:1 to about 1:15, from about 10:1 to about 1:10, from about 9:1 to about 1:9, from about 8:1 to about 1:8, from about 7:1 to about 1:7, from about 6:1 to about 1:6, from about 5:1 to about 1:5, from about 4:1 to about 1:4, from about 3:1 to about 1:3, or from about 2:1 to about 1:2.

In certain embodiments, the method disclosed herein further comprises a step of removing acidic components from the syngas before step (c). The acidic components can be carbon dioxide, sulfur compounds and other potential catalyst poisons that are generated in steps (a) and (b).

In some embodiments, the Step (c) can be carried out by a higher-alcohol-synthesis (HAS) process. In certain embodiments, the HAS process is provided by Haldor Topsoe A/S, Ravnholm, Denmark. The catalyst and conditions (e.g., temperature, pressure and reaction time) for the HAS process can be any suitable catalyst and conditions for converting a mixture of hydrogen and carbon monoxide in a suitable ratio to higher alcohols, particularly butanol and pentanol. The In some embodiments, the HAS process is designed to produce primarily butanol and pentanol as well as some hexanol, heptanol and octanol.

In certain embodiments, the method disclosed herein further comprises a separating step in which the higher alcohol mixture from the HAS Process can be refined to a usable final product using any separation process that can separate one or more components from the higher alcohol mixture; purify one or more components in the higher alcohol mixture; or enrich one or more components in the higher alcohol mixture. In some embodiments, the separation process is distillation. In other embodiments, the separation process can be designed to separarte, purify or enrich one or more isomers of the higher alcohol mixture produced in the HAS Process, e.g., isobutanol or isoamyl alcohol.

The catalytic process disclosed herein generally provides the amounts of butanol, pentanol, hexanol, heptanol and octanol in the ranges as disclosed herein. In some embodiments, the catalytic process also produces small amounts of other components in the product such as higher alcohols having 9 or more carbon atoms, esters and/or hydrocarbons. These trace components, left over from the refining process, is less than 1 vol. %, based on the total weight of the product. In some embodiments, the catalytic process also produces methanol, ethanol and proponal up to 3% respectively of the fuel additive.

This blend can also be added directly to a previously blended gasoline that contains either methanol or ethanol in any proportion. The same properties that make this fuel blend superior for the use in unblended gasoline, diesel or jet fuel are the same when added to a blended gasoline containing methanol or ethanol. The co-solvent properties of the butanol and pentanol bind the fuel additive to the primary fuel (whether gasoline, diesel or jet fuel) to provide an additive that increases fuel efficiency, reduces output of carbon dioxide, carbon monoxide and smog particulates. These co-solvent properties mitigate the problems of methanol and ethanol such as water solubility and high vapor pressure.

It is the combination of the higher hydrocarbon content, the longer carbon chain and the lower oxygen to carbon ratio that gives this fuel additive an energy content more similar to oil derived fuels than the lower alcohols. This same combination also provides better combustion performance in the engine with lower overall exhaust emissions. The C4 to C8 carbon chain is very similar to the carbon chains in gasoline at the lower end. The octane rating of butanol alone is 96 while gasoline is approximately 90, while pentanol, hexanol, heptanol and octanol all have similar octane levels.

The stoichiometric Air Fuel Ratio (AFR) of butanol is lower than that for gasoline, thus for the same amount of air that is induced into the engine (or furnace) more fuel must be injected and burnt to increase power. In gasoline, for optimum fuel efficiency, a stoichiometric ratio of 14.7:1 is preferred. The ratio of air mass to fuel mass is 14.7 air to 1 of fuel. Anything more than 14.7:1 is considered a rich mixture and anything lower than 14.7: is considered a lean mixture. Vehicles using an oxygen sensor or other feedback loop mechanism will adjust the fuel to air ratio depending on the fuel mixture. Lower air intake requirements would reduce the likelihood of engine damage due to the heat level of the burning of the fuel and detonation. Detonation refers to the uncontrolled burning of the fuel air mix inside the cylinder. Lower AFR's mean the engine can run more efficiently on leaner fuel mixtures. Testing has shown that the air requirements to burn one kilogram of unblended gasoline are 14.796 liters of air versus 11.158 liters of air to burn 1 kilogram of butanol. When the butanol is combined with the pentanol, the increase in the carbon chain and oxygen/hydrogen functionality allows for higher power without additional amounts of air to be taken into the firing chamber. Heptanol, hexanol and octanol only increase energy content further. This is the converse of methanol or ethanol, which release less energy than gasoline when combusted. This is why fuel efficiency falls when methanol or ethanol are blended with gasoline. With the same amount of air injected, the present invention burns more efficiently.

Selected chemical and physical properties of gasoline and alcohols are shown below. When pure higher alcohols are blended with gasoline, larger amounts are needed in the blend in order to match the oxygen content of lower alcohol blends. In general, as the alcohol concentration increases so does the blend's specific gravity. Fuel blends with higher alcohols are slightly denser than those with lower alcohols for given oxygen mass contents of 2.5% and 5.0%. The energy-mass density for each blend is predicted by summing up the mass weighted heating values of the neat components.

The higher the oxygen content in the blend, the lower its energy mass-density value. The decrease in the heating value is almost the same for blends with matched oxygen content. The energy-volume density for each blend is computed by multiplying its energy-mass density and its specific gravity. Blends with higher alcohols have larger energy-volume densities, when compared to those with lower alcohols for the given oxygen mass contents of 2.5% and 5.0%. For the same operating conditions, engines burning a stoichiometric mixture need to consume more alcohol-gasoline blend than neat gasoline.

The data gathered in Table 1 below show that density of the current invention will exceed either methanol or ethanol as a stand-alone fuel additive and is also expected to have higher energy density than any other available mixed or higher alcohol blend due to the high proportion of butanol and pentanol as well as the heptanol, hexanol and octanol.

TABLE 1

| | Methanol | Ethanol | N-Propanol | N-Butanol | N-Pentanol | Gasoline |
|---|---|---|---|---|---|---|
| Formula | $CH_3OH$ | $CH_3CH_2OH$ | $CH_3CH_2CH_2OH$ | $CH_3(CH_2)_2CH_2OH$ | $CH_3(CH_2)_3CH_2OH$ | — |
| Oxygen Content Mass fraction) | 0.50 | 0.35 | 0.27 | 0.22 | 0.18 | 0.00 |
| Molecular weight | 32.04 | 46.07 | 60.10 | 74.12 | 88.15 | 111.21 |
| Specific gravity | 0.79 | 0.79 | 0.80 | 0.81 | 0.81 | 0.74 |
| Energy-mass density (KJ/gm) | 19.93 | 26.75 | 30.94 | 33.22 | 34.84 | 42.91 |
| Energy-volume density ($KJ/cm^3$) | 15.78 | 21.11 | 24.86 | 26.90 | 28.38 | 31.87 |
| Stoichiometric air/fuel ration | 6.43 | 8.94 | 10.28 | 11.12 | 11.68 | 14.51 |

One of the advantages of using the fuel or fuel additive disclosed herein is that smoke and smog particulates can be reduced because alcohols are known to generate less smoke and smog particulates than petroleum based fuel such as gasoline and diesel fuel. Another advantage of using the fuel or fuel additive disclosed herein is that the latent heat of the the fuel disclosed herein is 2.3 times more than that of gasoline.

The evaporation of the fuel additive vapor as it is mixed into the combustion chamber can reduce the mixture temperature resulting in higher volumetric efficiency, leaving fewer particulates. In diesel engines, oxygenated fuels reduce the carbon available for soot precursors in the premixed flame region by oxidizing carbon monoxide to carbon dioxide. In addition, oxygenated fuel increase the radical content in the post premix flame region, which oxidize aromatic and limit the growth of polyaromatic hydrocarbons, which contribute to soot formation. The oxygen content of the higher alcohols in general does not allow the formation of carbon soot particulates. Soot is the end result of an incomplete burn. The azeotropic behaviors of the higher alcohols enhance their vaporization in engine operations.

Higher alcohols are better suited for blending with diesel and jet fuel. Due to the length of the carbon chains there is no phase separation as observed with methanol and ethanol. Further, the energy content of the present invention and the crude oil fuels is very similar. The additional presence of oxygen in the alcohol molecules provides for better fuel combustion in the gasoline based, diesel based and jet fuel based engines. In other words, the engines have better performance with higher efficiencies, which reduces emissions of carbon dioxide, carbon monoxide, unburned hydrocarbons and reduces the formation of nitrous oxides. As the alcohols have been synthetically produced, they do not contain any contaminants such as sulfur or metals so there is a reduction in the amount of sulfur dioxide and other contaminants released.

Another advantage of the fuel or fuel additive is the reduction in engine knock. As has been described in the background of the invention, one of the primary reasons for the use of MTBE was to decrease engine knock. Engine knock is the term applied to the detonation of the fuel air mixture outside of the normal parameters of the engine design. Engine knock releases more nitrous oxides and unburned hydrocarbons into the air. Knock resistance is a function of octane rating. Methanol and ethanol are superior to the higher alcohols for providing knock resistance. However, the C4 to C8 alcohols have sufficient octane for the current gasoline being produced today.

Higher alcohol-gasoline blends operated at higher efficiency when compared to neat gasoline, due to higher allowable engine compression ratios (15-20%). In addition, the higher alcohol/gasoline blend showed a much better resistance to knock than neat gasoline, as indicated by the knock resistance indicator (KRI) and the (RON+MON)/2 antiknock index. The overall ability of the blends to resist knock appears to be a function of the total oxygen content of the blend (i.e. the higher the oxygen content there is in the blend, the higher the knock resistance). Ignition delay and combustion interval data show that higher alcohol/gasoline blends tend to have faster flame speeds than gasoline alone.

The fuel or fuel additive disclosed herein is less susceptible to fluctuations in intake temperatures compared to other fuel additives such as ethanol or methanol, due to intermediate temperature heat releases that are comparable to gasoline. Stable intermediate temperature heat release has been found to be critical for achieving high loads without knock.

In comparing the chemistry of the fuel additive disclosed herein versus methanol or ethanol, pentanol in general does not exhibit any noticeable decrease in temperature during piston expansion because of its pre-ignition heat release, while an ethanol does exhibit a drop in temperature. This drop in temperature reduces efficiency. As this is consistent with the higher intermediate heat transfer capacities of pentanol, the fuel additive disclosed herein would also be less susceptible to drops in temperature during piston expansion.

Much of the emission of hydrocarbons during combustion is due to the incomplete combustion of the fuel. Due to the oxygen content of the higher alcohols in the the fuel or fuel additive disclosed herein, significant reductions in emissions of hydrocarbons and carbon monoxide can be achieved.

Reid Vapor Pressure (RVP) is a measure of how volatile a fuel mixture is and the evaporation rate of the fuel. The lower the Reid Vapor Pressure, the lower the evaporation is of the fuel. Especially in the warmer months and hotter climates, a low RVp is critical to avoid the evaporation of the lighter ends of the fuel. Methanol and ethanol have high RVPs. Evaporation of these fuel additives is a cause of ozone formation which is a negative consequence to the environment, exactly the opposite of the desired effect of this invention. Further, a higher RVP can lead to vapor lock in engines, where there is not enough fuel in the cylinders to fire and the engine will stall. In most locations, an RVP of 8 to 9 pounds per square inch (psi) is considered acceptable during the summer months and in warm locales, and in the winter, for colder locales, a RVP of up to 14 is considered acceptable. The very low RVP's of the C4 and above alcohols of less than 0.5 psi is a significant advantage to the refiners and provides more flexibility in adding additional less expensive high vapor pressure "light ends" to the gasoline. In some embodiments, the the fuel or fuel additive disclosed herein has a RVP less than about 2.0 psi, less than about 1.5 psi, less than about 1.0 psi, less than about 0.5 psi, less than about 0.25 psi, or less than about 0.1 psi.

The higher alcohols can be used to substitute for MTBE in conventional blends of gasoline. There are multiple types of gasoline that are refined, including conventional gasoline, winter oxygenated gasoline and reformulated gasoline. The anti knock and improved performance that is provided by MTBE can be equaled or surpassed by the fuel additive disclosed herein. Further, MTBE, is not bio-degradable because its chemical structure has a tertiary carbon-carbon bond while all of the alcohols in the present invention are biodegradable and have been through extensive testing as to their safety for the environment and humans.

One of the most significant impacts of the fuel additive disclosed herein is that unless it is run neat, or blended at a percentage that is similar to that of E-85, there would not be any adjustments to the current internal combustion engines. The density of the present invention is more than 82% of that of gasoline, and therefore the dosage of fuel injected per cycle would not require any changes when switching between gasoline and the blend of gasoline and the present invention. Unlike methanol, which would require significant modifications to both the engine and the parts that come into contact with the methanol, there are no tuning requirements for the higher alcohol fuel additive. Even ethanol, blended at a 15% or higher rate, has been found to damage engines and to run E-85 requires a completely different engine. As has been discussed previously, since most internal combustion engines have an oxygen sensor or other feedback mechanism to adjust for the effect of the fuel additive on the AFR of the blended gasoline, the need for modifications would be minimal. While the lambda sensor would reflect the changes to the oxygenate level of the blend of the fuel additive and gasoline, there are no negative effects on the function of the sensor.

Another very significant impact is the ability to deliver the blend of the present invention and gasoline at a higher ratio than can be achieved by other fuel additive/gasoline mixtures through the same distribution infrastructure that currently exists. At the present time, the miscibility issues of ethanol and methanol prevent the use of the current infrastructures except at blend levels of 10% or lower. The present invention can be blended at virtually any ratio desired as its density, miscibility with gasoline as well as the energy output is completely compatible with the oil based infrastructure that has been developed as the petroleum industry and the automobile industry have evolved. Without such a compatible invention, the likelihood of adoption is virtually nil as the infrastructure redevelopment costs would be prohibitive.

While it is the intention of the invention to provide for a seamless introduction into engines without requiring any change to the operation of these engines (and furnaces), the invention would accommodate the base designs of these engines and furnaces while small changes that could be made without large expense would enhance both the fuel efficiency qualities and the reduction in pollutants and greenhouse gases. Such changes would be the timing of the firing of the spark plugs or fuel injectors or the change in the fuel/air mixture to allow for the change in the volume of fuel necessary due to the oxygenates in the present invention. Another possible change that would not require redesign of the automotive engine would be to adjust the Environmental Control Unit (ECU) calibration for the emissions that would be generated by the standard mixture adopted of the fuel additive and gasoline.

All publications and patent applications mentioned in this specification are herein incorporated by reference to the same extent as if each individual publication or patent application was specifically and individually indicated to be incorporated by reference. Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

EXAMPLES

A significant amount of testing has been undertaken to determine data about either pure alcohols as blending agents for fuels. In the case of mixed alcohols, methanol, ethanol or a combination of the two were always included in the tests. A test commissioned by the United States Department of Energy, entitled "*Combustion Characteristics of Higher Alcohol/Gasoline Blends*" is representative of the methodologies that have been used in published studies.

Comparative Example A

Comparative Example A was Unleaded Test Gas 96 (UTG 96) from Phillips 66.

Comparative Example B

Comparative Example B is a mixture of UTG 96 (90 vol. %), methanol (0.6 vol. %), ethanol (0.22 vol. %), propanol (4.8 vol. %), butanol (2.4 vol. %), and pentanol (1.98 vol. %). The total alcohol content of Comparative Example B was 10 vol. %. The oxygen content of Comparative Example B was 2.72 wt. %. The properties of pure methanol, ethanol, propanol, butanol, and pentanol and UTG 96 are shown in Table 2 below.

TABLE 2

Properties of Pure Alcohols and UTG 96

| Property | UTG 96 | Methanol | Ethanol | Propanol | Butanol | Pentanol |
|---|---|---|---|---|---|---|
| Chemical Formula | $C_8H_{15}$ (Typ.) | $CH_3OH$ | $C_2H_5OH$ | $C_3H_7OH$ | $C_4H_9OH$ | $C_5H_{11}OH$ |
| Molecular Weight | 111.21 | 32.04 | 46.07 | 60.10 | 74.12 | 88.15 |
| Oxygen Content (wt. %) | 0.00 | 49.93 | 34.73 | 26.62 | 21.59 | 18.15 |
| Stoichiometric A/F | 14.51 | 6.43 | 8.94 | 10.28 | 11.12 | 11.68 |
| Specific Gravity | 0.7430 | 0.7193 | 0.7894 | 0.8037 | 0.8097 | 0.8148 |
| Boiling Point ° C. (° F.) | 34-207 (94-405) | 65 (149) | 78.3 (173) | 82.2 (180) | 82.7 (181) | |
| RVP KPa (psi) | 61.4 (8.9) | 32.4 (4.7) | 19.3 (2.8) | 9.0 (1.3) | 18.6 (2.7) | — |
| Net Heat of Combustion, kJ/L (BTU/gallon) | 31,913 (114,500) | 15,887 (57,000) | 21,183 (76,000) | 23,970 (86,000) | 25,921 (93,000) | 26,200 (94,000) |
| Latent Heat of Vaporization, kJ/L (BTU/gallon) | 223 (800) | 920 (3,300) | 725 (2,600) | 585 (2,100) | 474 (1,700) | 251 (900) |
| RON | 96.5 | 112 | 111 | 112 | 113 | — |
| MON | 87.2 | 91 | 92 | — | — | — |

The heats of combustion of Comparative Examples A and B were measured according to the ASTM D4809-95 specification and their values are shown in Table 3 below.

TABLE 3

Heats of Combustion of Comparative Examples A and B

| | kJ/kg | BTU/lb |
|---|---|---|
| Comparative Example A | 42,912 | 18,448 |
| Comparative Example B | 42,744 | 18,376 |

Example 1

Example 1 is a mixture of methanol, ethanol, propanol, butanol, pentanol, hexanol, heptanol and octanol, the amounts of which are in ranges as shown in Table 4 below. Example 1 can be prepared by mixing the corresponding alcohol ingredients which can be obtained commercially.

TABLE 4

| The formula of Example 1. | | |
|---|---|---|
| | Alcohol Range | |
| Alcohol | Min. Vol. % | Max. Vol. % |
| Methanol | 0% | 3% |
| Ethanol | 0% | 3% |
| Propanol | 0% | 5% |
| Butanol | 40% | 75% |
| Pentanol | 10% | 25% |
| Hexanol | 5% | 10% |
| Heptanol | 1% | 5% |
| Octanol | 1% | 5% |

Example 2

Example 2 can be prepared according to the following procedure. The fuel or fuel additive disclosed herein can be prepared by a thermochemical and catalytical process using a production facility comprising a unit for syngas generation, a unit for syngas conditioning, a unit for higher alcohol synthesis, and a unit for product separation.

The syngas generation unit is a counter-current fixed bed gasifier, co-current fixed bed gasifier, fluidized bed reactor, entrained flow gasifier or plasma gasifier. In the syngas generation unit, a biomass is used to produce a mixture comprising carbon monoxide and hydrogen. The gasification temperature is greater than about 700° C. with a controlled amount of oxygen and/or steam. Alternatively, the syngas generation unit is a steam reforming unit, auto-thermal reforming unit or partially oxidation technology unit; and natural gas is used to form a syngas comprising carbon monoxide and hydrogen.

The syngas generated in the syngas generation unit is passed to the the syngas conditioning unit. In the syngas conditioning unit, the ratio of hydrogen and carbon monoxide in the syngas is adjusted so that the syngas is suitable for being converted into higher alcohols instead of methanol and/or ethanol. The syngas conditioning unit comprising a water-gas shift reactor and a hydrogen membrane for the adjustment. The water-gas shift reaction is carried out in two stages. The reaction temperature of the first stage is at about 350° C. The reaction temperature of the first stage is from about 190 to about 210° C. The catalyst is iron oxide promoted with chromium oxide for the first stage and copper on a mixed support composed of zinc oxide and aluminum oxide for the second stage. The ratio of hydrogen and carbon monoxide in the syngas is adjusted to be from about 10:1 to about 1:10.

In the syngas conditioning unit, acidic components such as carbon dioxide, sulfur compounds and other potential catalyst poisons are removed from the syngas. The purified syngas are fed to the higher alcohol synthesis unit. The higher-alcohol-synthesis higher alcohol synthesis unit, catalyst and reaction conditions are provided by Haldor Topsoe A/S, Ravnholm, Denmark. Next, the impurities are removed by distillation or extraction to yield Example 2. Example 2 is a mixture of methanol (about 1.5 vol. %), ethanol (about 1.5 vol. %), propanol (about 2.5 vol. %), butanol (75 vol. %) and pentanol (about 15 vol. %), hexanol (about 1.5%), heptanol (about 1.5%) and octanol (about 1.5%).

As demonstrated above, embodiments of the invention provide various fuels, fuel additives or fuel compositions which are particularly useful as diesel, jet or gasoline fuels. Consequently, in some embodiments, the fuel, fuel additive or fuel composition has a shelf life of at least about one year, at least about two years, at least about three years, at least about four years, at least about five years, at least about ten years, at least about fifteen years, at least about twenty years, or at least about twenty five years.

While the invention has been described with respect to a limited number of embodiments, the specific features of one embodiment should not be attributed to other embodiments of the invention. No single embodiment is representative of all aspects of the invention. In some embodiments, the compositions may include numerous compounds not mentioned herein. In other embodiments, the fuels, fuel additives or fuel compositions do not include, or are substantially free of, any compounds not enumerated herein. Variations and modifications from the described embodiments exist. For example, the the fuel, fuel additive or fuel composition disclosed herein needs not be a mixture of alcohol. It can comprise any type of hydrocarbons or fatty esters or other biofuels. The appended claims intend to cover all such variations and modifications as falling within the scope of the invention.

What is claimed is:

1. A fuel comprising:

(a) a pentanol in an amount from about 10 vol. % to about 55 vol. %;

(b) a butanol in an amount from about 45 vol. % to about 90 vol. %;

(c) a propanol in an amount from 0 to about 5 vol. %;

(d) ethanol in an amount from 0 to about 3 vol. %;

(e) methanol in an amount from 0 to about 3 vol. %;

(f) a hexanol in an amount from 0.1 vol. % to 6 vol. %;

(g) a heptanol in an amount from 0.1 vol. % to 6 vol. %; and (h) an octanol in an amount from 0.1 vol. % to 6 vol. %, wherein all amounts are based on the total volume of the fuel.

2. The fuel of claim 1, wherein the pentanol is 1-pentanol, 2-pentanol, 3-pentanol, 3-methyl-1-butanol, 2-methyl-1-butanol, 2,2-dimethyl-1-propanol, 3-methyl-2-butanol, 2-methyl-2-butanol or a combination thereof, wherein the butanol is n-butanol, isobutanol, sec-butanol, tert-butanol or a combination thereof, and wherein the propanol is n-propanol, isopropanol or a combination thereof.

3. The fuel of claim 1, wherein the amount of the pentanol is more than 15 vol. % or more than 30 vol. %, based on the total volume of the fuel.

4. The fuel of claim 1, wherein the hexanol is 1-hexanol, 2-hexanol, 3-hexanol or a combination thereof, wherein the heptanol is 1-heptanol, 2-heptanol, 3-heptanol, 4-heptanol or a combination thereof, and wherein the octanol is 1-octanol, 2-octanol, 3-octanol, 4-octanol or a combination thereof.

5. The fuel of claim 1 further comprising a fuel additive selected from the group consisting of lubricity improvers, antioxidants, thermal stability improvers, cetane improvers, stabilizers, cold flow improvers, combustion improvers, anti-foams, anti-haze additives, corrosion inhibitors, icing inhibitors, injector cleanliness additives, smoke suppressants, drag reducing additives, metal deactivators, dispersants, detergents, demulsifiers, dyes, markers, static dissipaters, biocides and combinations thereof, wherein the fuel additive is substantially free from an oxygenate or an alcohol, wherein the alcohol is not methanol, ethanol, propanol, butanol, pentanol, hexanol, heptanol, octanol or a combination thereof.

6. The fuel of claim 1 further comprising a fuel component selected from the group consisting of diesel fuel, jet fuel, kerosene, gasoline, heating oil, fuel oil, bunker oil and combinations thereof.

7. A fuel additive comprising:

(a) a pentanol in an amount from about 10 vol. % to about 55 vol. %;

(b) a butanol in an amount from about 45 vol. % to about 90 vol. %;

(c) a propanol in an amount from 0 to about 5 vol. %;

(d) ethanol in an amount from 0 to about 3 vol. %;

(e) methanol in an amount from 0 to about 3 vol. %;

(f) a hexanol in an amount from 0.1 vol. % to 6 vol. %;

(g) a heptanol in an amount from 0.1 vol. % to 6 vol. %; and (h) an octanol in an amount from 0.1 vol. % to 6 vol. %, wherein all amounts are based on the total volume of the fuel additive.

8. The fuel additive of claim 7, wherein the pentanol is 1-pentanol, 2-pentanol, 3-pentanol, 3-methyl-1-butanol, 2-methyl-1-butanol, 2,2-dimethyl-1-propanol, 3-methyl-2-butanol, 2-methyl-2-butanol or a combination thereof, wherein the butanol is n-butanol. isobutanol, sec-butanol, tert-butanol or a combination thereof, and wherein the propanol is n-propanol, isopropanol or a combination thereof.

9. The fuel additive of claim 7, wherein the amount of the pentanol is more than 15 vol. % or more than 30 vol. %, based on the total volume of the fuel additive.

10. A fuel composition comprising a fuel component and a fuel additive, wherein the fuel additive comprises:

(a) a pentanol in an amount from about 10 vol. % to about 55 vol. %;

(b) a butanol in an amount from about 45 vol. % to about 90 vol. %;

(c) a propanol in an amount from 0 to about 5 vol. %;

(d) ethanol in an amount from 0 to about 3 vol. %;

(e) methanol in an amount from 0 to about 3 vol. %;

(f) a hexanol in an amount from 0.1 vol. % to 6 vol. %;

(g) a heptanol in an amount from 0.1 vol. % to 6 vol. %; and (h) an octanol in an amount from 0.1 vol. % to 6 vol. %, wherein all amounts are based on the total volume of the fuel additive.

11. The fuel composition of claim 10, wherein the fuel component is derived from petroleum or coal.

12. The fuel composition of claim 11, wherein the fuel component comprises diesel fuel, jet fuel, kerosene, gasoline, heating oil, fuel oil, bunker oil or a combination thereof.

13. The fuel composition of claim 10, wherein the amount of the pentanol is more than 15 vol. % or more than 30 vol. %, based on the total volume of the fuel additive.

14. The fuel composition of claim 10, wherein the fuel component comprises diesel fuel, jet fuel, kerosene, gasoline, heating oil, fuel oil, bunker oil or a combination thereof.

15. The fuel composition of claim 10, wherein the amount of the fuel additive is from about 1 vol. % to about 35 vol. %, based on the total volume of the fuel composition.

16. The fuel composition of claim 10, wherein the fuel component further comprises methanol, ethanol or a combination thereof.

17. The fuel composition of claim 10, wherein the pentanol is 1-pentanol, 2-pentanol, 3-pentanol, 3-methyl-1-butanol, 2-methyl-1-butanol, 2,2-dimethyl-1-propanol, 3-methyl-2-butanol, 2-methyl-2-butanol or a combination thereof wherein the butanol is n-butanol, isobutanol, sec-butanol, tert-butanol or a combination thereof, and wherein the propanol is n-propanol, isopropanol or a combination thereof.

* * * * *